US006786072B2

(12) United States Patent
Beutler et al.

(10) Patent No.: US 6,786,072 B2
(45) Date of Patent: Sep. 7, 2004

(54) METHOD OF FABRICATING A HEAT EXCHANGER TUBE

(75) Inventors: Andreas Beutler, Weissenhorn (DE); Manfred Knab, Dornstadt (DE); Andreas Knoepfler, Ulm (DE); Axel Kriegsmann, Ulm (DE); Klaus Menze, Ulm (DE); Gerhard Schuez, Voehringen (DE); Andreas Schwitalla, Illerrieden (DE)

(73) Assignee: Wieland-Werke AG, Ulm (DE)

( * ) Notice: Subject to any disclaimer, the term of this patent is extended or adjusted under 35 U.S.C. 154(b) by 0 days.

(21) Appl. No.: 10/254,486

(22) Filed: Sep. 25, 2002

(65) Prior Publication Data

US 2003/0024121 A1 Feb. 6, 2003

Related U.S. Application Data

(62) Division of application No. 10/042,487, filed on Jan. 9, 2002.

(30) Foreign Application Priority Data

Jan. 16, 2001 (DE) ..... 101 01 589

(51) Int. Cl.[7] ..... B21B 19/12

(52) U.S. Cl. ..... 72/98; 72/100; 29/890.05

(58) Field of Search ..... 72/98, 100, 102, 72/103, 107; 29/890.048, 890.05; 165/179, 183, 184

(56) References Cited

U.S. PATENT DOCUMENTS

| | | | | | |
|---|---|---|---|---|---|
| 4,179,911 | A | * | 12/1979 | Saier et al. | 72/78 |
| 4,313,248 | A | * | 2/1982 | Fujikake | 29/890.051 |
| 4,353,234 | A | * | 10/1982 | Brothers et al. | 72/98 |
| 5,896,660 | A | * | 4/1999 | Rieger | 29/890.049 |
| 6,067,832 | A | * | 5/2000 | Brand et al. | 72/98 |

FOREIGN PATENT DOCUMENTS

| | | | | |
|---|---|---|---|---|
| JP | 59-199137 | * | 11/1984 | 72/98 |
| RU | 923661 | * | 5/1982 | 72/98 |

* cited by examiner

*Primary Examiner*—Ed Tolan
(74) *Attorney, Agent, or Firm*—Flynn, Thiel, Boutell & Tanis, P.C.

(57) ABSTRACT

A metallic heat transfer tube, in particular for the evaporation of liquids from pure substances or mixtures on the outside of the tube. Fins are integrally formed on the outside of the tube. Recesses are arranged in the area of the base of the primary grooves and extend between the fins. The recesses are in the form of re-entrant secondary grooves. The mechanical stability of the tube is not negatively influenced because material is primarily removed from the fin flanks toward the base of the groove so that the re-entrant secondary grooves are radially open.

8 Claims, 9 Drawing Sheets

METHOD OF FABRICATING A HEAT EXCHANGER TUBE

This is a division of Ser. No. 10/042,487, filed Jan. 9, 2002.

FIELD OF THE INVENTION

The invention relates to a metallic heat transfer tube, in particular for the evaporation of liquids from pure substances or mixtures on the outside of the tube.

BACKGROUND OF THE INVENTION

Evaporation occurs in many areas of air conditioning and refrigeration engineering and in process and energy engineering. Shell and tube heat exchangers are often used in this type of engineering, in which exchangers liquids from pure substances or mixtures evaporate on the outside of the tube, and thereby cool off a brine or water on the inside of the tube. Such devices are identified as flooded evaporators.

By intensifying the heat transfer on the outside and the inside of the tube, it is possible to significantly reduce the size of the evaporator. This reduces the manufacturing costs of such devices. Furthermore the required filling capacity of refrigerant is reduced which, in the case of the current predominantly used HFCs, can amount to a significant portion of the entire cost of the system. Furthermore, the potential of danger can be reduced, in the case of toxic or flammable refrigerants, by a reduction of the filling capacity. The current common double enhanced tubes are more efficient by approximately a factor of three than plain tubes with the same diameter.

STATE OF THE ART

The present invention relates to structured tubes in which the heat transfer coefficient is intensified on the outside of the tube. Since the main portion of the heat transfer resistance is in this manner often shifted to the inside, the heat transfer coefficient must as a rule also be intensified on the inside. An increase of the heat transfer on the inside of the tube results usually in an increase of the tubeside pressure drop.

Heat transfer tubes for shell and tube heat exchangers have usually at least one structured area and one plain end and possibly plain center lands. The plain ends or center lands provide the limits of the structured areas. In order for the tube to be able to be installed without any problems into the shell and tube heat exchanger, the outer diameter of the structured areas may not be greater than the outer diameter of the plain ends and center lands.

In order to increase the heat transfer during the evaporation, the process of the nucleate boiling is intensified. It is known that the formation of bubbles starts at the nucleation sites. These nucleation sites are mostly small gas or vapor inclusions. Such nucleation sites can be produced already by roughening the surface. When the growing bubble has reached a certain size, it becomes detached from the surface. When the bubble becomes detached, the nucleation site is flooded with liquid and any included gas or vapor may also be displaced by the flooding liquid. The nucleation site is in this case inactivated. This can be avoided by a suitable design of the nucleation sites. It is here necessary to make the opening of the nucleation site smaller than the cavity lying below the opening.

It is known in the art to produce such structures on the base of integrally formed finned tubes. Integrally finned tubes are where the fins are formed out of the wall material of a plain tube. Various methods are known whereby the channels between adjacent fins are closed off in such a manner that connections between channel and surrounding area remain in the form of pores or slots. Since the opening of the pores or slots is less than the width of the channels, the channels represent suitably formed cavities, which favor the formation and stabilization of nucleation sites. Such essentially closed channels are created in particular by bending or tilting the fin (U.S. Pat. Nos. 3,696,861, 5,054, 548), by splitting and flattening the fin (DE 2 758 526, U.S. Pat. No. 4,577,381), and by notching and flattening the fin (U.S. Pat. No. 4,660,630, EP 0 713 072, U.S. Pat. No. 4,216,826).

The strongest commercially available performance enhanced fin tubes for flooded evaporators have a fin structure with a fin density of 55 to 60 fins per inch on the outside of the tube (U.S. Pat. No. 5,669,441, U.S. Pat. No. 5,697, 430, DE 197 57 526). This corresponds to a fin pitch of approximately 0.45 to 0.40 mm. It is principally possible to improve the performance of such tubes with a yet higher fin density or smaller fin pitch since this increases the nucleation site density. A smaller fin pitch requires automatically more delicate tools. However, more delicate tools are subjected to an increased danger of breakage and quicker wear. The presently available tools enable a safe manufacture of finned tubes with fin densities of 60 fins per inch at a maximum. Furthermore a decreasing fin pitch reduces the production speed of the tubes and consequently the manufacturing costs are increased.

It is known that performance-enhanced evaporation structures without changing the fin density can be produced on the outside of the tube by structuring the base of the groove between the fins. It is suggested in EP 0 222 100 to provide the base of the groove with indentations by means of a notching disk. The indentations at the base of the groove can have a V, trapezoidal or semicircular cross section and represent additional nucleation sites. However, the performance increases achievable by such structures in particular in the range of small heat fluxes no longer meet the demands of the market. The indentations represent furthermore a weakening of the core wall of the tube and result in a reduction of the mechanical stability of the tube.

PURPOSE OF THE INVENTION

A performance-enhanced heat transfer tube for the evaporation of liquids on the outside of the tube is to be provided during a uniform tubeside heat transfer and pressure drop and with the same manufacturing costs.

SUMMARY OF THE INVENTION

The purpose of the invention is met by providing in a heat transfer tube of the mentioned type, recesses which are arranged in the area of the base of the primary grooves helically extending between the fins, in such a manner that the recesses are designed in the form of re-entrant secondary grooves.

A re-entrant groove (see FIG. 1) exists when in a sectional plane a not closed off field X can be found;

the field X can be closed off by means of a region AB;

a region PQ, with P, Q being part of a boundary of X, is found so that PQ is parallel to AB and the width of PQ is greater than the width of AB.

A re-entrant secondary groove offers for the formation and stabilization of nucleation sites clearly more favorable conditions than the simple indentations suggested in EP 0 222 100. The position of the re-entrant secondary grooves near the primary base of the groove is particularly advantageous for the evaporation process since the wall superheat is the greatest at the base of the groove and therefore the highest driving temperature difference for the bubble formation is available thereat.

After the forming of the fins material is according to the invention removed by suitable additional tools, from the area of the fin flanks toward the base of the groove so that not completely closed off cavities are created at the base of the groove, which cavities define the desired re-entrant secondary grooves. The cavities extend from the base of the primary groove toward the tip of the fins, whereby the cavities expand at a maximum up to 45% of the fin height H, typically up to 20% of the fin height H. The fin height H is thereby measured from the lowermost portion of the base of the groove, which was formed by the largest rolling disk, to the fin tip of the completely formed finned tube.

BRIEF DESCRIPTION OF THE DRAWINGS

The invention will be discussed in greater detail hereinafter in connection with reference to the accompanying drawings, in which.

DETAILED DESCRIPTION

Figure 1:
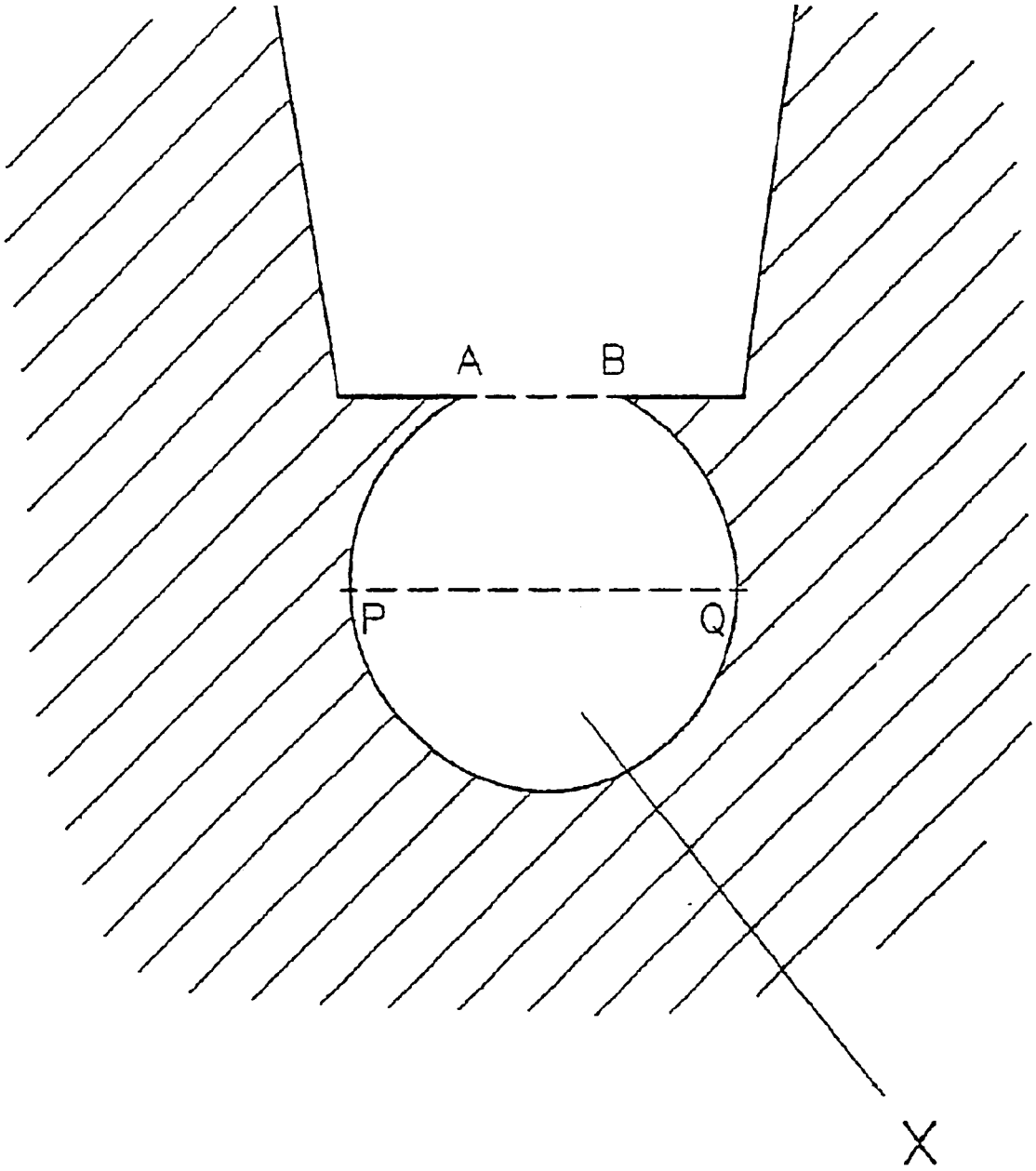
FIG. 1 is the principle sketch of a re-entrant groove.

An integrally rolled finned tube 1 according to FIGS. 2 to 7 has fins 3 extending helically on the outside of the tube, between which fins a primary groove 4 is formed. Material of the fin flanks 5 is suitably shifted so that cavities 7, which are not completely closed off, are created in the area of a base 6 of each of the primary grooves 4, which cavities represent the re-entrant secondary grooves of the invention. Material of the fin tips 8 is shifted in such a manner that the spaces between the fins are closed off to thereby form channels 9 externally accessible through radially open pores 26.

The finned tube of the invention is manufactured through a finning process (compare U.S. Pat. Nos. 1,865,575, 3,327,512) by means of the devices illustrated in FIGS. 2, 4 and 6.

A device is utilized, which consists of n=3 or 4 arbors 10, onto each of which a rolling tool 11 is integrated. The arbors 10 are circumferentially offset at 360°/n on the periphery of the finned tube. The arbors 10 can be moved radially. They in turn are arranged in a stationary (not illustrated) milling head.

Figure 2:
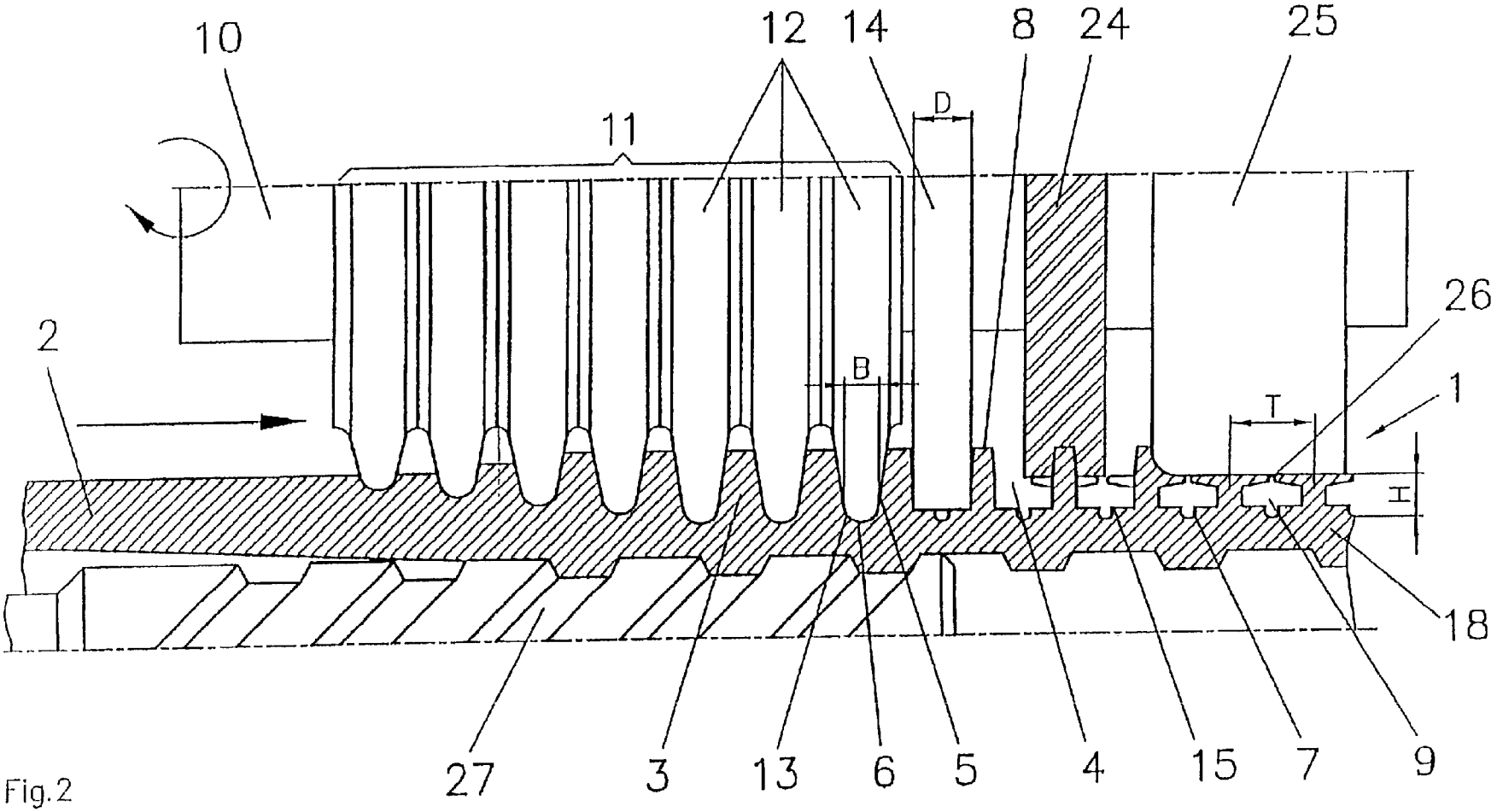
FIG. 2 illustrates schematically the manufacture of a heat transfer tube of the invention with re-entrant secondary grooves, which extend helically with an essentially constant cross section on the outside of the tube.
Figure 3:
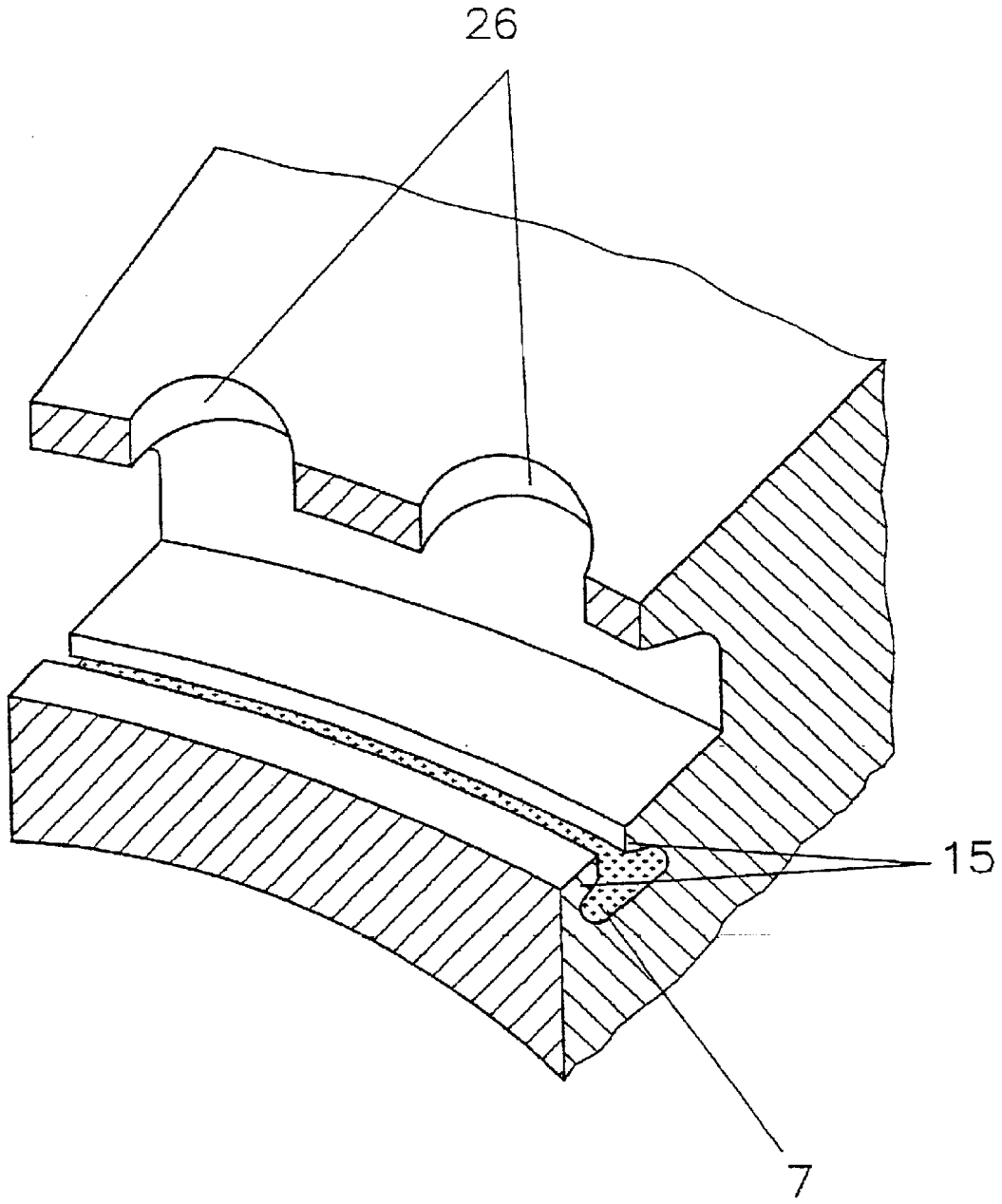
FIG. 3 is a partial view of a heat transfer tube of the invention with re-entrant secondary grooves, which extend helically with an essentially constant cross section.
Figure 4:
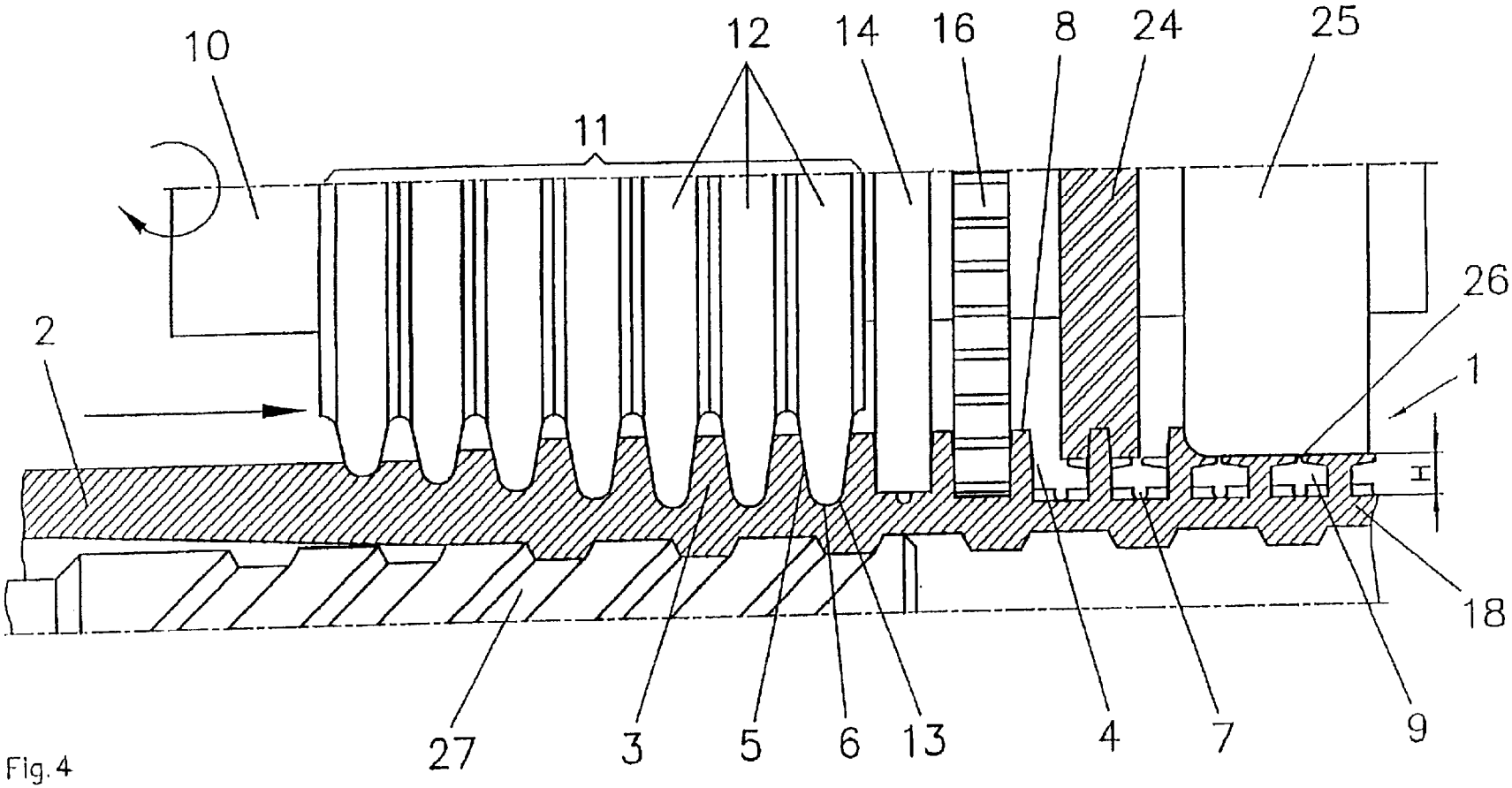
FIG. 4 illustrates schematically the manufacture of a heat transfer tube of the invention with helically extending, re-entrant secondary grooves, the cross section of which is varied at regular intervals.
Figure 5:
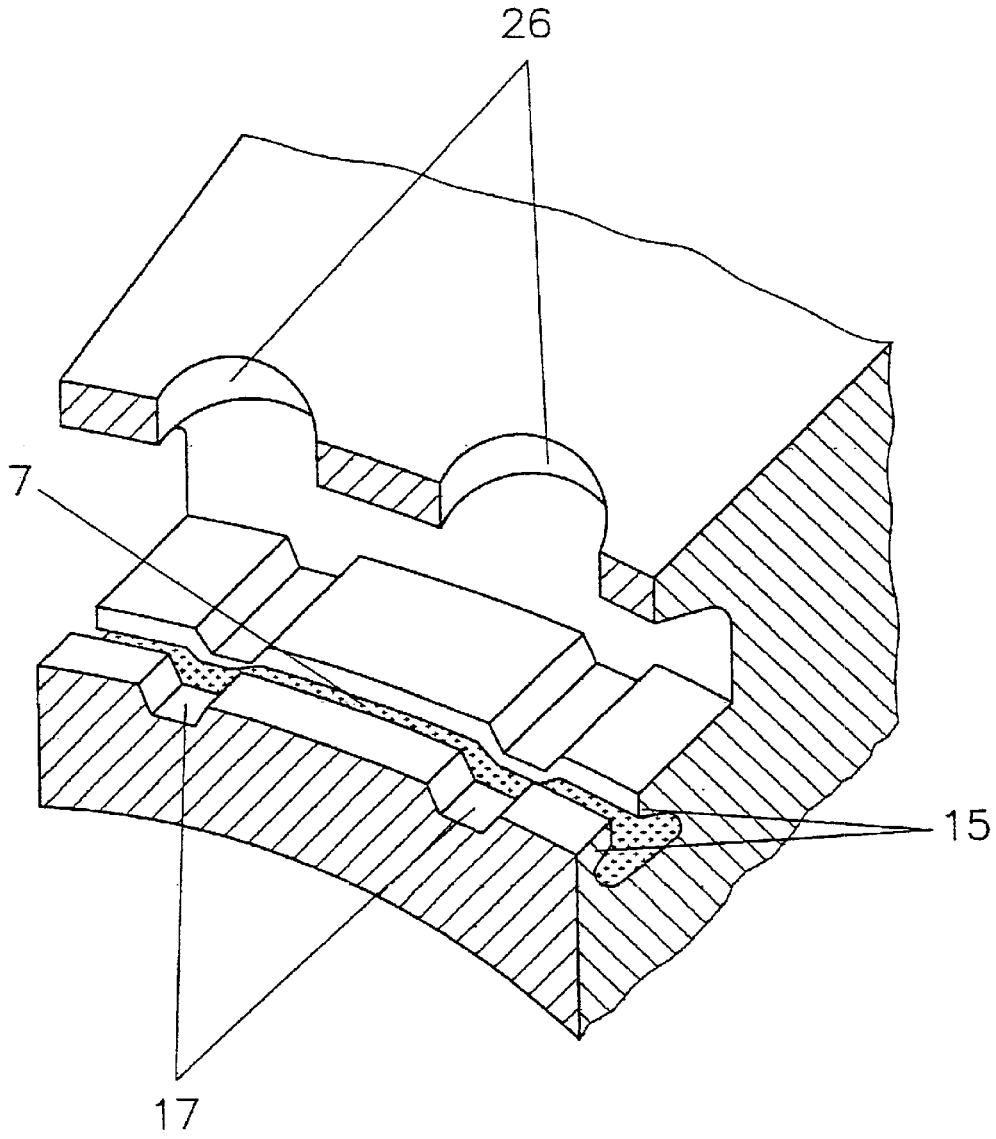
FIG. 5 is a partial view of a heat transfer tube of the invention with helically extending, re-entrant secondary grooves, the cross section of which is varied at regular intervals.
Figure 6:
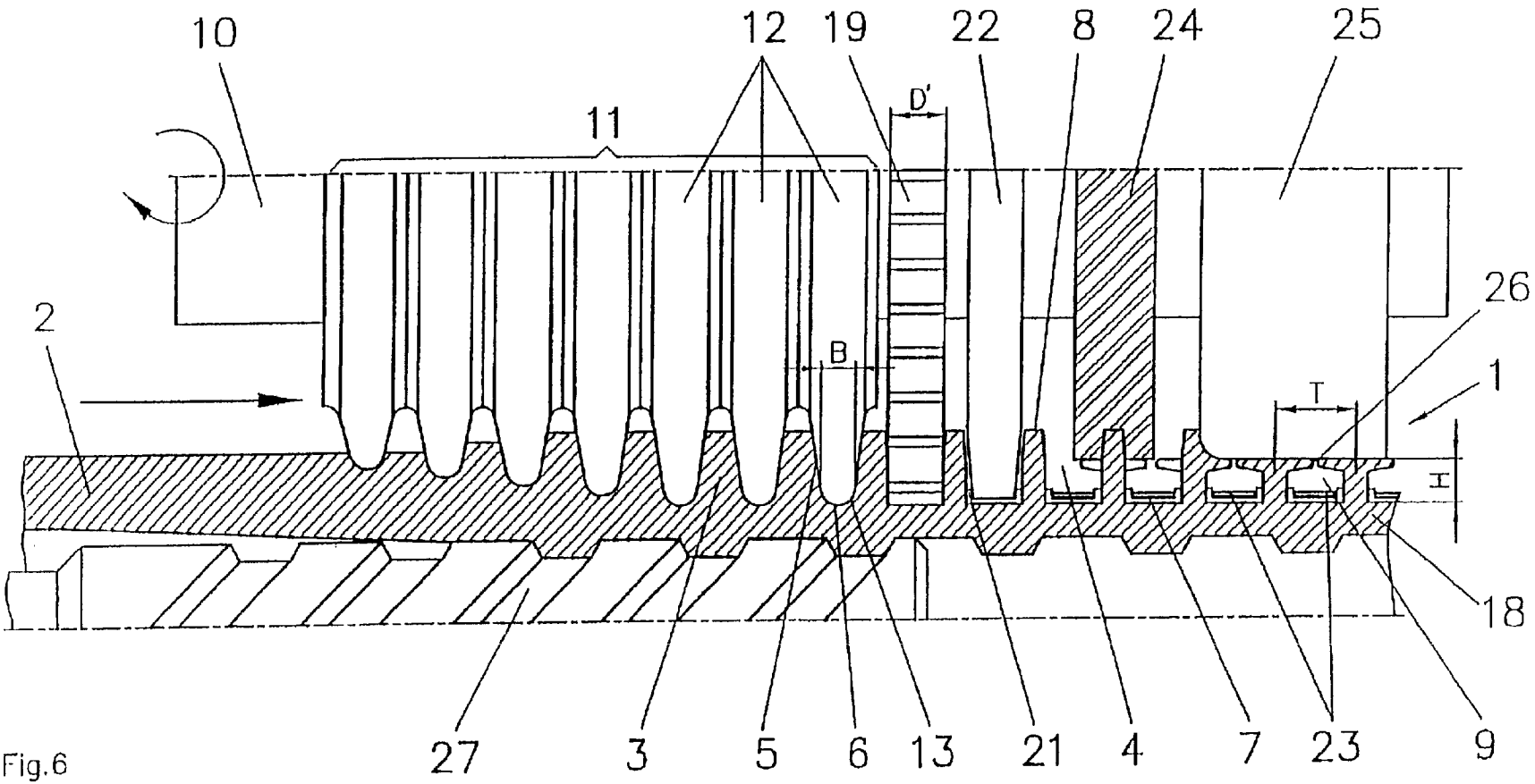
FIG. 6 illustrates schematically the manufacture of a heat transfer tube of the invention with re-entrant secondary grooves, which extend essentially transversely to the direction of the primary grooves.

The plain tube 2 entering the device in direction of the arrow in FIGS. 2, 4 and 6 is rotated by the peripherally arranged rotating rolling tools 11. The axes of the rolling tools 11 extend in a skewed relation to the tube axis. The rolling tools 11 consist in a conventional manner of several side-by-side arranged rolling disks 12, the diameter of which increases in the direction of the arrow. The centrally arranged rolling tools 11 form the helically extending fins 3 out of the tube wall of the plain tube 2. The tube wall is supported in the shaping zone by a mandrel 27. The mandrel 27 can be profiled. The distance between the centers of two adjacent fins, which distance is measured lengthwise with respect to the tube axis, is identified as the fin pitch T. The rolling disks are profiled on their outer periphery in such a manner that the formed fins 3 have an essentially trapezoidal cross section. The fin deviates from the ideal trapezoidal shape only in the transition area 13 between fin flank 5 and the base 6 of the groove. This transition area 13 is usually identified as root of the fin. The there formed radius is needed in order to enable an unobstructed material flow during formation of the fins.

After the essentially trapezoidally shaped fins 3 have been formed by the rolling tool 11, the re-entrant secondary grooves 7 of the invention are created in the area of the base 6 of the primary grooves 4. Three different tool embodiments can be used for this purpose:

Embodiment 1 (FIG. 2)

A cylindrical disk 14 is provided immediately after the last disk 12 of the rolling tool 11. The diameter of the disk 14 is less than the diameter of the largest rolling disk 12. The thickness D of the cylindrical disk 14 is slightly greater than the width B of the primary groove 4 formed by the rolling disks 12, the width B of the primary groove 4 being measured at the point where the fin flank 5 transfers over into the radius area of the root of the fin 13. The thickness D of the cylindrical disk is typically 50% to 80% of the fin pitch T. The cylindrical disk 14 removes material from the fin flanks 5 and effects a movement thereof toward the base 6 of the primary groove 4. The removed material is shifted by suitably selecting the tool geometry in such a manner that it forms projections 15 (FIG. 3) above the base 6 of the primary groove 4 and thus a radially open closed off cavity 7 is formed directly at the base 6 of the primary groove 4. This cavity 7 extends in circumferential direction and has a predominately uniform cross section. The cavity 7 defines the heretofore mentioned re-entrant secondary groove of the invention.

It is advantageous to provide on the radially outer surface of the disk 14 a concave profile (not shown), either continuous or in spaced arcuate segments in order to facilitate the removal of the material of the fin side 5.

Since the diameter of the cylindrical disk 14 is less than the diameter of the largest rolling disk 12 of the rolling tool 11, the lowermost portion of the base 6 of the primary groove 4 is not worked by the cylindrical disk 14. The tube wall 18 is thus not weakened during the forming of the re-entrant secondary grooves 7.

Embodiment 2 (FIG. 4)

This embodiment represents an expansion of Embodiment 1. That is, a gear-like notching disk 16 is provided immediately after the cylindrical disk 14. The diameter of the notching disk 16 is greater than the diameter of the cylindrical disk 14, however, at most as great as the diameter of the largest rolling disk 12 of the rolling tool 11. The cavity 7 formed by the cylindrical disk 14 and extending in circumferential direction and having a uniform cross section is partitioned by indentations 17 (FIG. 5) formed in the radially outer roof thereof by the notching tool 16 at regular intervals in the circumferential direction. Thus, the heretofore uniform cross section of the circumferentially extending re-entrant secondary grooves 7 is now varied at regular intervals. The notching disk 16 can be straight or helically toothed.

Since the diameter of the gear-like notching disk 16 is not greater than the diameter of the largest rolling disk 12 of the rolling tool 11, the lowermost portion of the base 6 of the primary groove 4 is not farther recessed by the gear-like notching disk 16. The tube wall 18 is thus not weakened during the forming of the re-entrant secondary grooves 7 according to Embodiment 2.

Embodiment 3 (FIG. 6)

Figure 7:
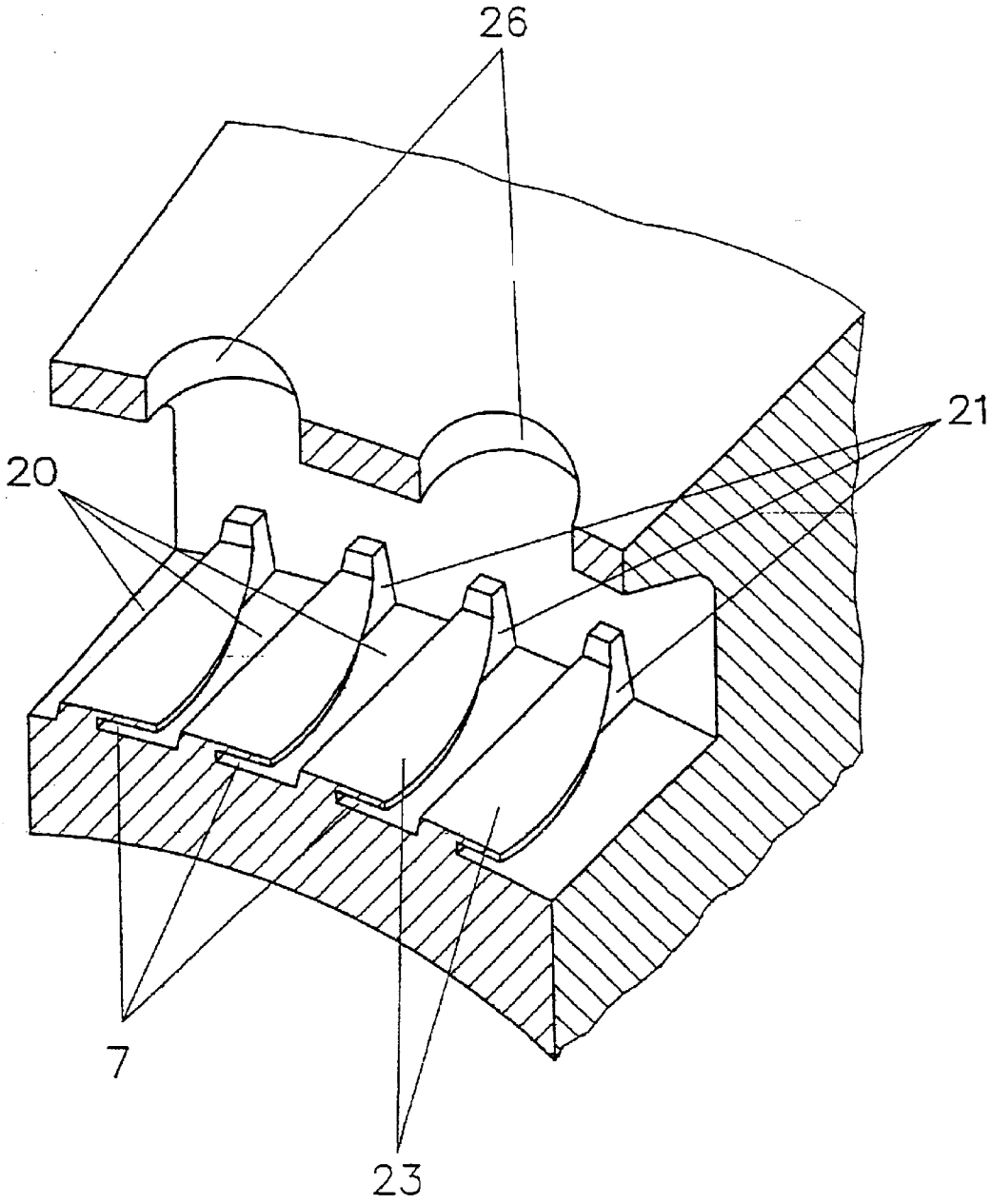
FIG. 7 is a partial view of a heat transfer tube of the invention with re-entrant secondary grooves, which extend essentially transversely with respect to the direction of the primary grooves.

A gear-like notching disk 19 is provided immediately after the last disk 12 of the rolling tool 11. The diameter of the notching disk 19 is at most as great as the diameter of the largest rolling disk 12. The thickness D' of the notching disk 19 is slightly greater than the width B of the primary groove 4 formed by the rolling disks 12, the width B of the primary groove 4 being measured at the point where the fin flank 5 transfers over into the radiused portion of the root of the fin 13. The thickness D' of the notching disk is typically 50% to 80% of the fin pitch T. The notching disk 19 can be straight or helically toothed. The notching disk 19 removes material from the area of the fin flanks 5 and from the radiused portion of the root of the fin 13 to thereby form spaced-apart indentations 20 (FIG. 7). The removed material is preferably shifted into the not worked area between the individual indentations 20 so that coined dams 21 are formed on the base 6 of the primary groove 4. The dams 21 extend transversally to the circumferentially extending primary grooves 4 and between the mutually adjacent fins 3. A next following finishing rolling disk 22 of a uniform diameter deforms the upper areas of the dams 21 to cause material movement in direction of the tube circumference so that small cavities 7 are formed between two mutually adjacent dams 21 and between the deformed upper area 23 of the dams 21 and the base 6 of the groove (FIG. 7). These cavities 7 are the heretofore mentioned re-entrant secondary grooves of the invention. The diameter of the finishing rolling disk 22 must be chosen to be less than the diameter of the notching disk 19 working the base of the grooves.

Since the diameter of the gear-like notching disk 19 is not greater than the diameter of the largest rolling disk 12 of the rolling tool 11, the lowermost portion of the base 6 of the primary groove 4 is not farther recessed by the gear-like notching disk 19. The tube wall 18 is thus not weakened during the forming of the re-entrant secondary grooves 7 according to the Embodiment 3.

After the re-entrant secondary grooves 7 have been formed at the base 6 of the groove, the fin tips 8 are notched by means of a gear-like notching disk 24. The notching disk 24 is also illustrated in FIGS. 2 and 4, as well as in 6. A flattening of the notched fin tips subsequently occurs caused by one or several flattening disks 25. The fins 3 thus become formed into an essentially T-shaped cross section, and the grooves 9 formed between the fins 3 are closed off but for the radially open pores 26 (see FIGS. 3, 5 and 7).

The fin height H is measured at the finished fin tube 1 from the lowermost portion of the base 6 of the groove to the tip of the fin of the completely formed fin tube.

The re-entrant secondary grooves 7 of the invention at the base 6 of the primary grooves 4 extend from the base 6 of the groove toward the fin tip. The cavities 7 expand at a maximum to 45% of the fin height H, typically to 20% of the fin height H.

Figure 8:
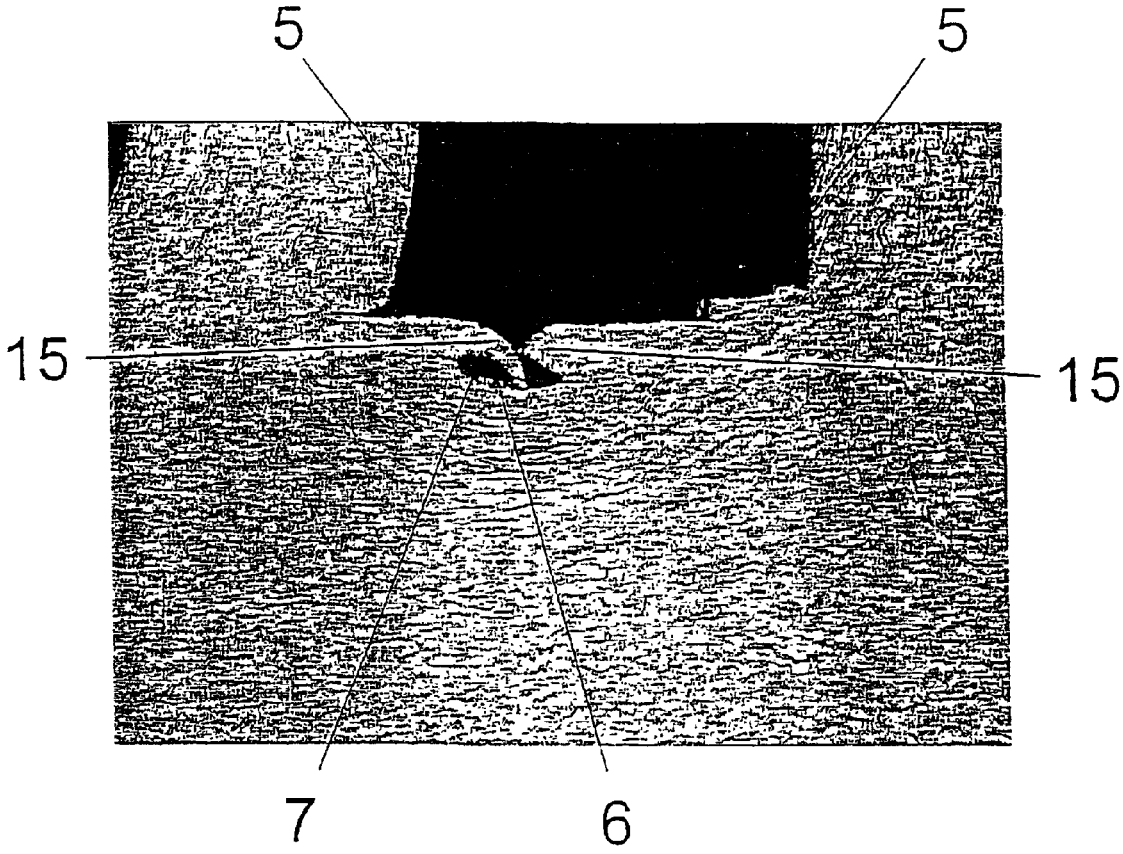
FIG. 8 is the photo of a re-entrant secondary groove of the invention at the base of the groove, which groove extends helically with an essentially constant cross section.

FIG. 8 shows a photo of a re-entrant secondary groove 7 of the invention at the base 6 of the groove. The sectional plane is perpendicular with respect to the circumferential direction of the tube. An example according to the tool Embodiment 1 is here illustrated. The recognizable asymmetry of the structure is caused by unavoidable tolerances in tool dimensions and starting-material dimensions.

Figure 9:
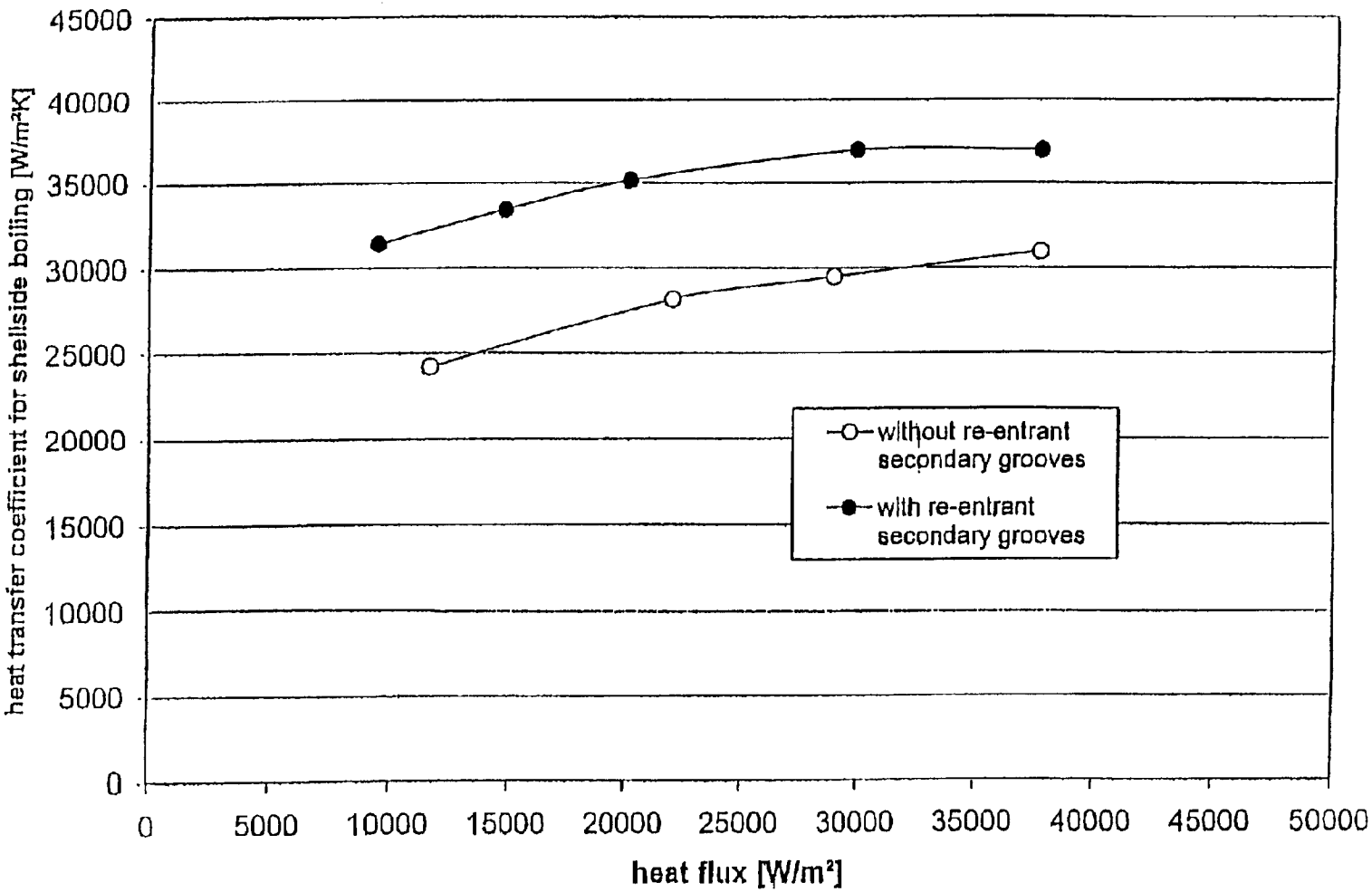
FIG. 9 is a diagram, which documents the performance advantage by the re-entrant secondary groove at the base of the groove.

FIG. 9 illustrates a comparison of the performance characteristics of two finned tubes during shellside boiling of the refrigerant HFC-134a. One of the tubes has been designed with re-entrant secondary grooves at the base of the groove. Illustrated is the heat transfer coefficient for shellside boiling as a function of the heat flux. The equilibrium temperature is hereby 14.5° C. It will be recognized that a performance advantage is achieved utilizing the re-entrant secondary grooves at the base of the groove, which advantage is over 30% during small heat fluxes, and approximately 20% during large heat fluxes.

Structures with re-entrant secondary grooves at the base of the groove are also suggested in EP 0 522 985. However, the structure is oriented on the inside of a tube. In order to guarantee the mechanical stability of such tubes in particular when expanding the tubes, the secondary grooves must be designed as flat as possible. This is achieved by the acute-angled geometry of the secondary grooves described in EP 0 522 985. Usually a higher pressure exists inside the tube during the tubeside evaporation of refrigerants than on the outside of the tube. An increased mechanical load on the wall of the tube starts with an internal pressure load from the acute-angled edges of the secondary grooves due to the stress concentration. This must be compensated for by a thicker tube wall. This added safety in the tube wall results, however, in an increased usages of material and thus in increased costs.

However, no weakening of the tube wall 18 occurs in the heretofore suggested design of the re-entrant secondary grooves 7 in the area of the base 6 of the primary groove on the outside of the finned tubes since to form the secondary grooves 7 material is used exclusively from the area of the fin flanks 5 and possibly from the radiused portion 13 above the base 6 of the groove.

We claim:

1. A method for the manufacture of a metallic heat transfer tube, the steps comprising:

a) supporting a plain tube on a mandrel oriented inside thereof;

b) roll forming helically extending and radially outwardly extending fins so that flank surfaces on mutually adjacent fins are axially spaced from one another to define a primary groove therebetween having a bottom wall laterally bordered by roots providing a transition surface between the bottom wall and the respective flank surfaces; and c) roll forming the mutually facing flank surfaces and the roots bordering the bottom wall into a reformed bottom wall having a reformed juncture with the mutually adjacent fins and at least one re-entrant secondary groove having a width less than an axial spacing between the junctures between the reformed bottom wall and the mutually adjacent fins.

2. The method according to claim 1, wherein the at least one re-entrant secondary groove has an essentially uniform cross section, wherein the roll forming in step c) forms by means of a cylindrical disk having a diameter less than a diameter of a largest rolling disk and a thickness which is at least 50% and at most 80% of a fin pitch T.

3. The method according to claim 1 wherein the method step c) is followed by a method step d) in which the bottom wall of the primary groove is deformed in places by a further roll forming utilizing a gear-like notching disk having a diameter which is greater than the diameter of the cylindrical disk, at a maximum, however, as great as the diameter of the largest rolling disk, in such a manner that indentations are formed and which are spaced at regular intervals from one another in circumferential direction.

4. The method according to claim 3, wherein in a straight or helically toothed notching disk is used.

5. The method according to claim 1, wherein the roll forming in method step c) includes a utilization of a gear-like notching disk, a diameter of which is less than a diameter of a largest rolling disk, to form circumferentially spaced-apart dams, and wherein a method step d) follows and includes a utilization of a cylindrical finishing rolling disk to deform a top part of each darn to form plural re-entrant secondary grooves.

6. The method according to claim 5, wherein in each case a straight or helically toothed notching disk is used.

7. The method according to one of the claims 2 to 6, wherein tips of the fins are notched in a further method step e) by roll forming utilizing a gear-like notching disk.

8. The method according to claim 7, wherein the tips of the fins are flattened to an essentially T-shaped cross section in a method step f) by a further roll forming utilizing at least one flattening disk.

* * * * *